US009802633B1

(12) United States Patent
Nishinaga et al.

(10) Patent No.: US 9,802,633 B1
(45) Date of Patent: Oct. 31, 2017

(54) FIXED GUIDEWAY TRANSPORTATION SYSTEMS HAVING LOWER COST OF OWNERSHIP AND OPTIMIZED BENEFITS

(75) Inventors: Eugene Iwao Nishinaga, San Rafael, CA (US); Kevin Kohei Nishinaga, San Rafael, CA (US); Neil Sinclair, Richmond, CA (US); Harry Burt, Concord, CA (US); Dexter Vizinau, El Sobrante, CA (US)

(73) Assignee: CYBERTRAN INTERNATIONAL INC., Richmond, CA (US)

( * ) Notice: Subject to any disclaimer, the term of this patent is extended or adjusted under 35 U.S.C. 154(b) by 1484 days.

(21) Appl. No.: 13/218,422

(22) Filed: Aug. 25, 2011

Related U.S. Application Data

(60) Provisional application No. 61/459,247, filed on Dec. 10, 2010.

(51) Int. Cl.

| | |
|---|---|
| ***B61L 27/04*** | (2006.01) |
| ***B61L 3/00*** | (2006.01) |
| ***G08G 1/00*** | (2006.01) |
| ***B61B 1/02*** | (2006.01) |
| ***B61B 3/02*** | (2006.01) |

(52) U.S. Cl.
CPC ..... *B61L 27/04* (2013.01); *B61B 1/02* (2013.01); *B61B 3/02* (2013.01); *B61L 3/00* (2013.01); *G08G 1/20* (2013.01)

(58) Field of Classification Search
None
See application file for complete search history.

(56) References Cited

U.S. PATENT DOCUMENTS

| | | | | |
|---|---|---|---|---|
| 3,552,321 | A * | 1/1971 | Priebe | 104/18 |
| 4,965,583 | A | 10/1990 | Broxmeyer | |
| 6,263,799 | B1 * | 7/2001 | Pardes | 104/28 |
| 2005/0038575 | A1 * | 2/2005 | Wu | 701/19 |
| 2008/0015745 | A1 | 1/2008 | Gaegauf et al. | |
| 2008/0154452 | A1 | 6/2008 | Kapp et al. | |
| 2008/0167767 | A1 | 7/2008 | Brooks et al. | |
| 2010/0114407 | A1 | 5/2010 | Klooster et al. | |
| 2010/0318247 | A1 | 12/2010 | Kumar | |
| 2010/0319565 | A1 | 12/2010 | Mobasher | |

OTHER PUBLICATIONS

Dearien, John A., Struthers, Richard D., McCarthy, Kent D.. "Cybertran: A Systems Anslysis Solution to the High Cost and Low Passenger Appeal of Conventional Rail Transportation Systems". CyberTran International, Inc.. http://www.cybertran.com/ , Archived by archive.org on May 18, 2004.*

(Continued)

*Primary Examiner* — Rami Khatib
*Assistant Examiner* — Jeffrey Boomer
(74) *Attorney, Agent, or Firm* — Pillsbury Winthrop Shaw Pittman LLP

(57) ABSTRACT

The present invention relates generally to ground transportation systems, and more particularly to a fixed guideway transportation system that achieves a superior ratio of benefits per cost, is lower in net present cost and thus more easily justified for lower density corridors, and can provide passenger carrying capacities appropriate for higher density corridors serviced by mass rapid transit systems today.

18 Claims, 9 Drawing Sheets

(56) References Cited

OTHER PUBLICATIONS

Morgantown Personal Rapid Transit System."System Operation Description Manual M-PRT-1-1." West Virginia University. http://transportation.wvu.edu/r/download/18440 , Archived by archive.org on Mar. 7, 2009.*

Anderson, J. Edward. "Automated transit vehicle size considerations." Journal of Advanced Transportation. 20(2):97-105. 1986.*

Baker, Jeffrey K. "Advanced Automatic Train Control pioneered in San Francisco." Railway Gazette International. Jun. 2002.*

Dearien, John A and Plum, Martin A. "The Capital, Energy, and Time Economics of an Automated, On-Demand Transportation System." IEEE AES Systems Magazine. Nov. 1993.*

Verkehrsverbund Rhein-Ruhr. "Linienplan Schnellverkehr" Verkehrsverbund Rhein-Ruhr.2006.*

Nishinaga, et al., "A Vehicle Collision Avoidance System Using Time Multiplexed Hexadecimal FSK", Boeing Aerospace Company, IEEE/Vehicular Technology Conference, vol. 33, 1983, pp. 171-182.

Burt, H.G.P., et al., "Microprocessor Control of Wheel Slip," IEEE, 1985, pp. 19-28.

* cited by examiner

FIXED GUIDEWAY TRANSPORTATION SYSTEMS HAVING LOWER COST OF OWNERSHIP AND OPTIMIZED BENEFITS

CROSS-REFERENCE TO RELATED APPLICATIONS

The present application claims priority to U.S. Provisional Application. No. 61/459,247, filed Dec. 10, 2010, the contents of which are incorporated herein by reference in their entirety.

FIELD OF THE INVENTION

The present invention relates to ground transportation, and more particularly to fixed guideway transportation systems having an optimal ratio of benefits per cost and a method for designing the same.

BACKGROUND OF THE INVENTION

Modern mass rapid transit rail systems are very effective carriers of people. They are generally grade separated systems to enable vehicles to operate unaffected by automobile traffic, and thereby are able to achieve traffic densities otherwise unachievable. They are, however, very expensive. A typical, but conservative order of magnitude system capital cost for a system is approximately $100 million per bi-directional track mile of system, making it difficult for communities and cities to justify and/or afford the cost of new construction. This limitation has the effect of constraining the reach of these systems, and thus limiting the convenience to the users who can only ride the systems to the few locations to which guideway has been constructed. This results in a classic case of Catch 22. The high cost of systems requires a high ridership to justify the cost. However, high guideway costs limit construction and thus the reach of fixed guideway systems. This limits convenience to the riders, making it difficult to achieve the high ridership needed to justify the high cost.

Conventional mass rapid transit rail technology attempts to improve the benefits per cost by focusing on serving the commuting public. This means building systems to achieve very high passenger capacities to major employment centers. An example conventional system is shown in FIG. 1. As shown, conventional systems 110 achieve high capacities by building heavy infrastructure and operating long heavy trains 112 that typically carry a large number of riders to the few large employment centers that they can most effectively service, while bypassing smaller towns or communities. This, however, requires very costly guideway 122 and station structures 124, which limits the system's reach and thus convenience for the users, especially for those who want to travel to the generally more widely distributed retail, residential, or recreational destinations.

With guideway 122 and station structures 124 that must be built to handle long heavy trains 112 to support demand during commute hours, the result is an expensive but marginally justifiable solution for commute hour travel which is far too expensive to justify for other periods of the day and other destinations.

Other existing transportation systems that aim to be less expensive to build and operate include automated people mover (APM) systems, such as those operating in many modern airports and some cities. These systems are low speed/low capacity systems that operate driverless vehicles at speeds in the range of 25 to 30 mph and achieve line capacities in the range of 2,000 to 3,000 passengers per hour per direction. Given the limited speed and capacity of these systems, even with the somewhat lower cost of construction due to the use of smaller vehicles, the benefit/cost is still poor. Furthermore, with the lower speeds and line capacities, these systems are limited in utility to local service routes.

Another type of transportation system that has been discussed is called "personal rapid transit" (PRT). PRT's differ from the more common APM systems in that these systems are built with offline stations which allow higher traffic densities to be achieved. Typically these systems operate driverless cars that seat four to six people and can provide service on a personal demand-driven basis. However, with the very small cars, high speeds are difficult to achieve and line capacities are severely restricted. There is one PRT that is operating at West Virginia University, the Morgantown PRT, which is an 8.2 mile long system having cars that seat 20 people. With a claim of 15 second headways a line capacity of 4,800 passengers per hour per direction can be achieved. With rubber-tired vehicles, however, the top speed of the system is 30 mph thus limiting its applicability to low speed local service lines.

Although the above examples are, sometimes considered "modern era" technologies, a more traditional but yet still widely deployed form of rail transit is conventional light rail transit (LRT). These systems operate rail cars at street level and thus intermingled with automobile traffic. The rail vehicles are not driverless and traffic density is severely limited due in large part by the fact that street inter-sections must be kept unobstructed for a significant percentage of time to allow for automobile traffic to cross. Given the dangers of operating in mixed traffic with cars and pedestrians, LRT systems typically limit their speeds to under 30 mph. Furthermore, although cars can be operated in consists of 2 to 4 cars, longer consists are impractical in mixed traffic, which then limits line capacities to about 4,000 passengers per hour per direction. Again, with the low speeds and low capacity, the LRT technology has not shown itself to be practical for anything more than local service lines.

SUMMARY OF THE INVENTION

The present invention relates generally to ground transportation systems, and more particularly to a fixed guideway transportation system that achieves a superior amount of benefits per cost, is lower in net present cost and thus more easily justified for lower density corridors, and can provide passenger carrying capacities appropriate for higher density and higher speed corridors serviced by mass rapid transit systems today.

According to some aspects, a driverless transportation system according to the invention consists essentially of: a fixed guideway forming a route for transporting a plurality of driverless vehicles thereon, grade separated at all mode crossings along the route, off-line stations at all stops within the route, and a control system for controlling movement of the vehicles throughout the route, wherein the control system comprises controllers in each of the vehicles communicating with one or more higher-level controllers located in stations and even higher-level controllers located in central dispatch centers, wherein vital control functions are concentrated in the higher-level controllers (and typically only in the station level controllers), and wherein the control system provides an optimal traffic density by eliminating fixed obstacles along the route, and wherein the vehicles are sized to transport an optimal number of passengers for the optimal traffic density.

BRIEF DESCRIPTION OF THE DRAWINGS

These and other aspects and features of the present invention will become apparent to those ordinarily skilled in the art upon review of the following description of specific embodiments of the invention in conjunction with the accompanying figures, wherein.

DETAILED DESCRIPTION OF THE PREFERRED EMBODIMENTS

Figure 1:
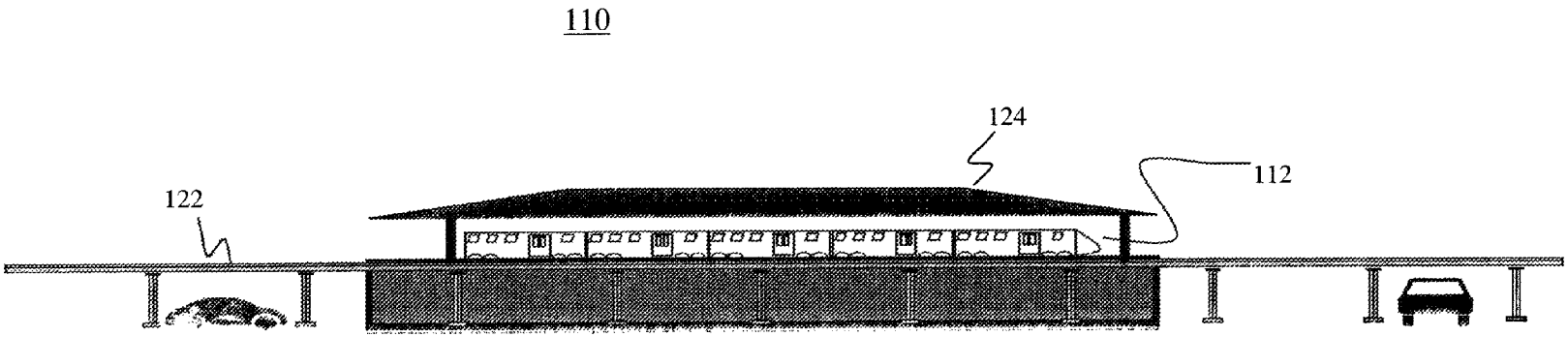
FIG. 1 (PRIOR ART)
FIG. 1 illustrates a conventional mass transit system.

The present invention will now be described in detail with reference to the drawings, which are provided as illustrative examples of the invention so as to enable those skilled in the art to practice the invention. Notably, the figures and examples below are not meant to limit the scope of the present invention to a single embodiment, but other embodiments are possible by way of interchange of some or all of the described or illustrated elements. Moreover, where certain elements of the present invention can be partially or fully implemented using known components, only those portions of such known components that are necessary for an understanding of the present invention will be described, and detailed descriptions of other portions of such known components will be omitted so as not to obscure the invention. Embodiments described as being implemented in software should not be limited thereto, but can include embodiments implemented in hardware, or combinations of software and hardware, and vice-versa, as will be apparent to those skilled in the art, unless otherwise specified herein. In the present specification, an embodiment showing a singular component should not be considered limiting; rather, the invention is intended to encompass other embodiments including a plurality of the same component, and vice-versa, unless explicitly stated otherwise herein. Moreover, applicants do not intend for any term in the specification or claims to be ascribed an uncommon or special meaning unless explicitly set forth as such. Further, the present invention encompasses present and future known equivalents to the known components referred to herein by way of illustration.

According to certain aspects, the present invention enables the construction of rail lines that: 1. achieve a superior amount of benefits per cost; 2. are lower in cost and thus more easily justified for lower density corridors; and 3. can provide passenger carrying capacities appropriate for higher density corridors serviced by mass rapid transit systems today.

In certain embodiments of the invention, these objectives are met by utilizing smaller vehicles that can operate on a less expensive infrastructure. Using certain methods according to the invention, the costs of fixed guideway mass rapid transit systems are reduced, allowing more destinations to be accessed. Also, with certain methods according to the invention, the same structures appropriate for low ridership corridors and/or service hours can be used to achieve passenger carrying capacities needed for the high capacity corridors served today by modern mass rapid transit systems.

According to further aspects, the invention improves the amount of benefits per cost of rail transit by reducing the cost to levels more justifiable for low density corridors. To be meaningful, certain methods according to the invention achieve improved benefits per cost in a holistic manner, in other words, by reducing the net cost of ownership which includes not only the cost of equipment but also the net cost of operating and maintaining the system.

Although the principles of the invention will be explained in connection with applications to conventional diesel and/or electrified rail systems, the invention is not limited to these types of systems. For example, the principles of the invention can be extended to conventional and other vehicle technologies that do not rely on steel wheels rolling on steel rail.

Figure 2:
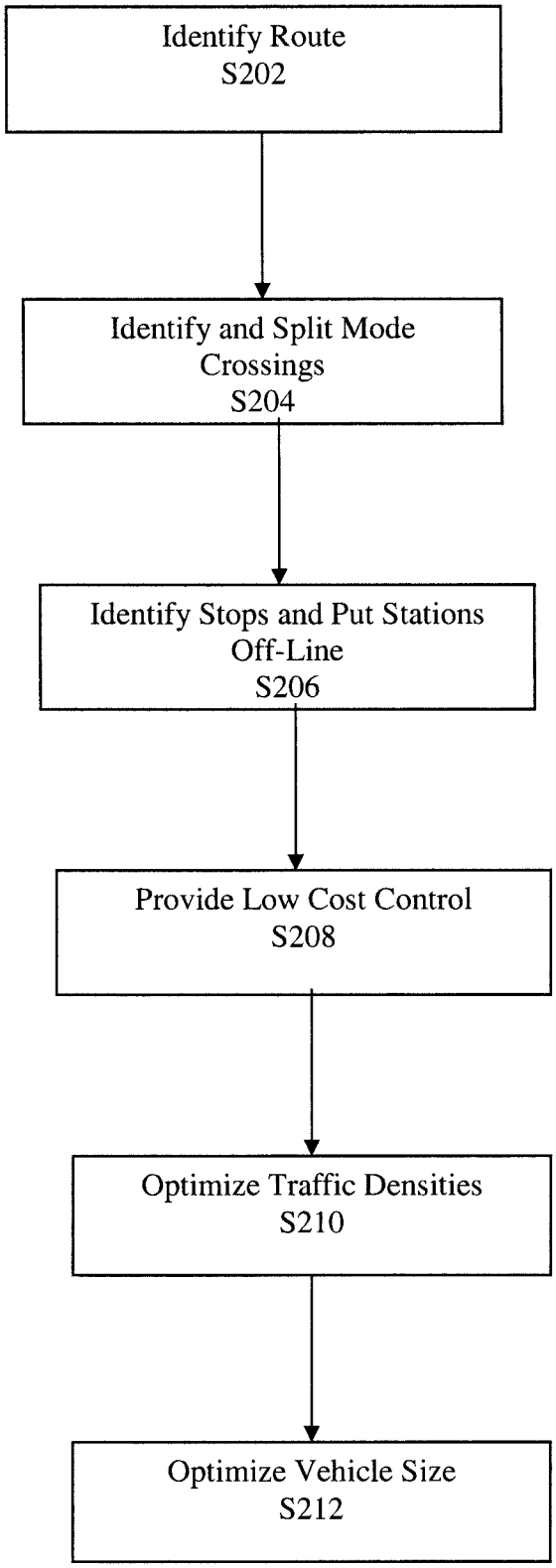
FIG. 2 illustrates an example method of providing a fixed guideway transportation system according to aspects of the invention.

One example method for designing a system according to the invention includes the following steps, as illustrated in FIG. 2: S202—Identify route for system; S204—identify mode crossings along the route and use grade-separated track at mode crossings; S206—identify station locations along route and construct station platforms where stopped vehicles will not obstruct traffic flow; S208—provide a cost effective way of controlling operation of the system (e.g. driverless cars with lower cost controllers); S210—Develop the capability to safely achieve traffic densities for the system that is greater than that achievable with current train control systems; and S212—determine the size of cars for the system that achieve an improved amount of benefits per cost with a lower net current cost.

These steps are preferably all performed in combination to provide an advantage of this invention which is to reduce the cost of fixed rail systems while at the same time improving the benefits per cost of fixed rail. A more detailed discussion of example implementations of the above-mentioned steps of the invention follows.

The first step of identifying a route for the system may be optional and is not necessary for the invention. For example, this step may be predetermined by an existing right-of-way or other existing plan. Moreover, the performance of this step may further depend on the scale of the system involved. For example, for a small system such as for a college campus, an important consideration for a route may be the locations of main buildings such as large residence halls, common student activity buildings such as libraries, eating facilities, and major classroom buildings. For a larger system such as a city, an important consideration may be the locations of major residential areas, major shopping areas, and major employment areas.

A route for a system according to the invention may or may not be closed loop. A route may or may not include branches and/or spurs. A route may or may not include a connection to another system. A route may fully or partially include bi-directional track sections (two tracks, one in each direction), multiple tracks for each direction, and/or where high density is not required, single track sections where vehicles are allowed to run in both directions. Those skilled in the art will understand how to adapt the principles of the invention to each of these possible implementations after being taught by the present disclosure.

An example step S204 of constructing grade-separated track will now be described in more detail.

As shown in FIG. 1, the present inventors recognize that one advantage of rail over automobile/bus travel is the ability to operate multiple cars in trains 112 without operators in each car. This allows long trains to be operated with fewer operators thus lowering the cost of operations. The disadvantage of operating long trains, however, is that long trains obstruct street 130 traffic for long periods of time when passing locations where the two modes intersect 128. This in turn means traffic density must be made sparse to allow cars and buses to co-exist with rail. With sparse traffic, long trains 112 are needed to achieve capacity which of course makes traffic obstruction worse. Balancing of train length and train frequency to achieve a given level of service thus becomes a necessity.

The above need to achieve balance is particularly acute in urban areas where capacity requirements are high and the frequency of cross traffic is also high. This makes rail, despite its many advantages, unsuited to the urban application.

Figure 3A:
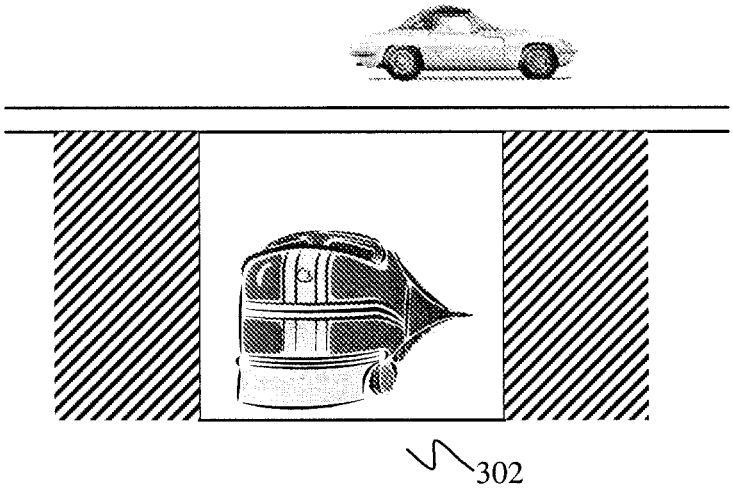
FIGS. 3A and 3B illustrate grade-separated track according to embodiments of the invention.
Figure 3B:
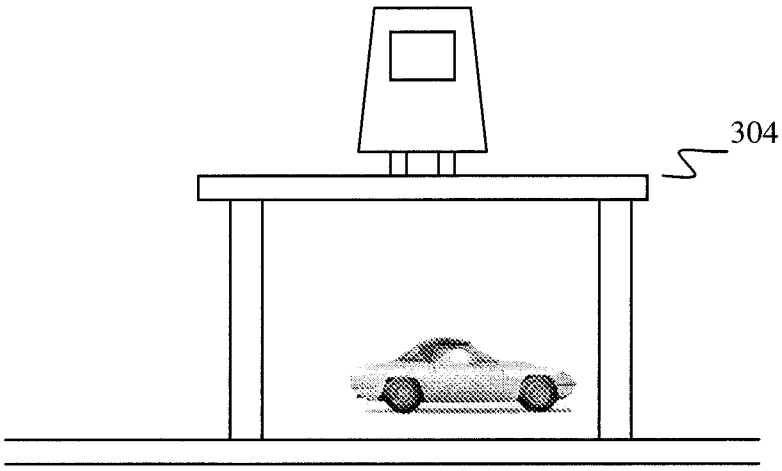

One aspect of the claimed invention is therefore to build the track infrastructure in a way that allows for traffic-separated operation. This can typically be done by achieving vertical spatial separation where the two modes cross, typically referred to as grade-separated track. As shown in FIGS. 3A and 3B, respectively, this can be done either by placing the street traffic above the tracks 302 or by placing tracks 304 above the street traffic. The use of grade separated track, is thus a preferred aspect of the invention in order to achieve the high traffic densities necessary to provide high passenger carrying capacities with smaller lighter cars whereby lightweight, cost-effective supporting structures can be used.

Running the track 302 under street traffic may be implemented in many ways, such as a tunnel or underpass. Running the track 304 over street traffic may be implemented in many ways, such as a bridge or continuous elevated structure. It should be apparent that the guideway/roadway for carrying traffic for either mode can be elevated, underground or at grade and still provide grade separation at intersections, and that grade separation at various intersections in a single system can be implemented using the same or different types of structures for each mode.

An example next step S206 of constructing station platforms where stopped vehicles will not obstruct traffic flow will now be described in more detail.

Given the ability to operate without interfering with street traffic, another infrastructure issue to be addressed is the station platform. As shown in FIG. 1, on conventional systems, passenger platforms 124, 126 are constructed on-line, in other words where the vehicle 112 stopped in the platform 124 will obstruct passage on the main line 122. The time in the station 124 thus limits capacity of the system because, while the stopped vehicle is in the platform, the same track cannot be used by passing vehicles 112. This restriction must be removed if traffic densities are to be made high enough to achieve an improved ratio of benefits per cost.

Figure 4:
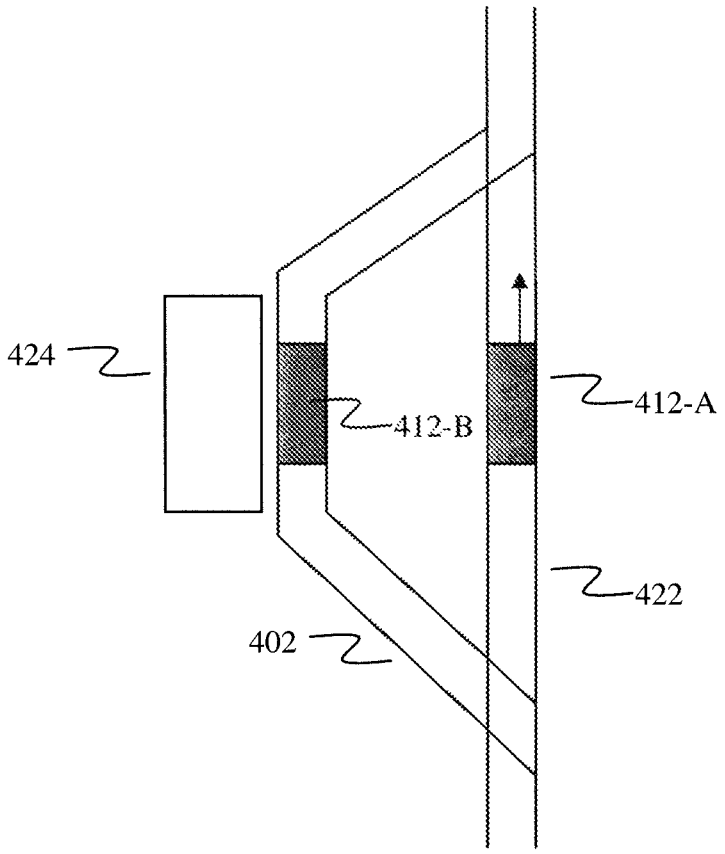
FIGS. 4A and 4B illustrate off-line stations according to embodiments of the invention.

Thus another aspect of this claimed invention is the construction and use of off-line stations. For example, as shown in FIG. 4, embodiments of the invention include off-line platforms 424 that are separated and accessed from main line 422 by ramp line 402. Using proper controls (e.g. track and/or car switches) and sequencing, this allows train 412-A to pass by the location of the platform 424 and to continue on without stopping, even if the platform 424 is occupied by a stopped train 412-B. Such controls can further allow train 412-B to safely proceed onto the mainline 422 from ramp line 402 after picking up and/or dropping off passengers at platform 424 and after train 412-A has passed. In this way, the mainline track 422 can be used more effectively.

Ramp line 402 can be implemented in many different ways and the invention is not limited to the design depicted in FIG. 4. The only criteria for the track alignment is that it provides access to a platform that is off the main line. A few examples are shown in FIG. 5 (discussed later). Another point to make here is that the elevation of the off-line platform does not have to be at the same level as the mainline track. In fact, if the platform track is placed at a higher elevation, the effect of gravity will help to slow an arriving car and help accelerate a departing car and allow the off ramp and on ramp to be shorter. If the platform track is placed at a lower elevation, then the effect is the opposite, thus requiring longer on ramps and off ramps. The advantage of the latter is that system users do not have be brought to an elevated platform with escalators, elevators, and/or stairs.

FIG. 4 illustrates the off line station concept for a single track line. In practice, it can be expected that most applications will construct two parallel lines with one traveling in the opposite direction from the other. Thus the principle of off-line stations according to the invention is extended to accommodate such construction. In these embodiments, there are two different situations that are preferably addressed, each requiring different approaches. First, stations that are needed at locations that are not at the ends of the system, referred to as mid-line stations. Second, stations at the ends of lines, or end-of-line stations where vehicles must stop and then turn back to travel in the direction from which it came. As explained above, there are many different ways of eliminating the stopped vehicle as an obstacle for each situation. Only one example for each is provided below.

Figure 5A:
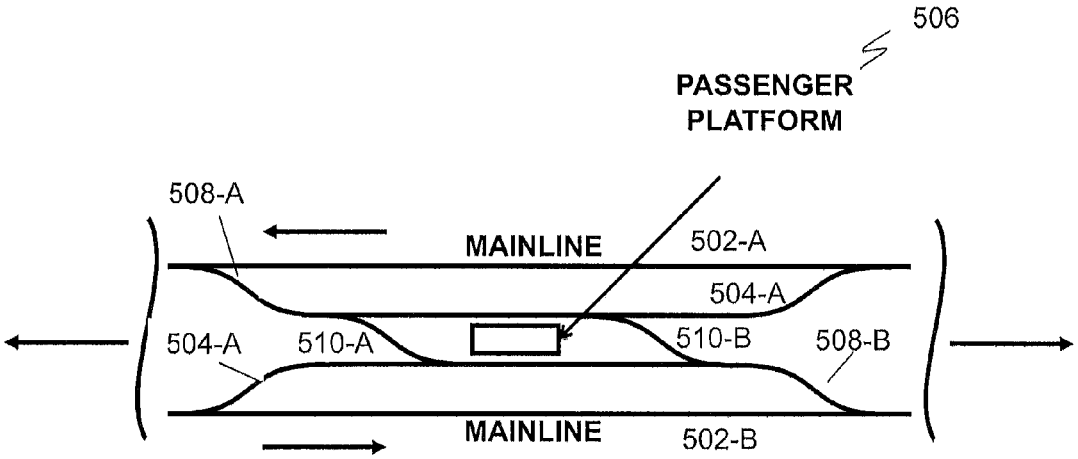
FIGS. 5A and 5B illustrate off-line stations according to alternative embodiments of the invention.

FIG. 5A illustrates an example mid-line station according to aspects of the invention. For mid-line stations it is preferable that vehicles are able to leave mainline track 502-A and 502-B as well as enter mainline track 502-A and 502-B from stations without impeding traffic flow in ways that adversely affect the travel times on the mainline. In order to achieve this, vehicles must decelerate off of the mainline track 502-A and 502-B using an off-ramp 504-A and 504-B, stop at the platform 506, dwell and then accelerate back onto the mainline using an onramp 508-A and 508-B.

Another desirable but not necessarily required feature for mid-line stations is that vehicles, after stopping will be able to dispatch back onto the mainline 502-A and 502-B traveling in either direction without incurring extra time to turn the vehicle around. With the crossover tracks 510-A and 510-B shown in FIG. 5A and the use of bi-directional vehicles (i.e. vehicles that can travel in both directions), this is achieved. This added feature enables more efficient operation of the system.

At end-of-line stations, an issue is how to bring multiple vehicles into a platform area and not have incoming vehicles blocked by vehicles already berthed at a station platform.

Figure 5B:
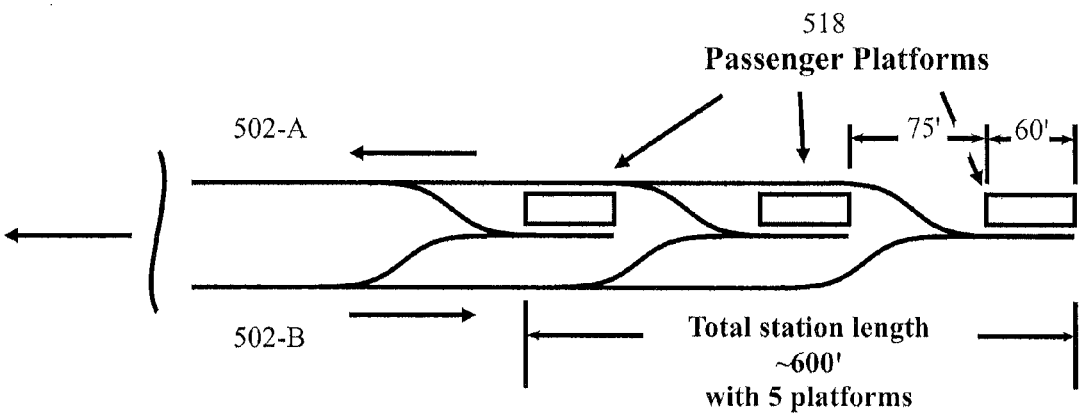

This is so that the time for off-loading and loading passengers on a stopped vehicle does not directly affect the frequency at which vehicles can be routed into the station. FIG. 5B illustrates one way in which this can be achieved.

In the example in FIG. 5B, a vehicle stopped at one of the two platforms 518 shown is not an obstacle for another vehicle arriving to stop at another of the platforms 518. This allows the rate at which vehicles can be turned back at the end-of-line location to be uninhibited by the platform dwell time (time that vehicle must stop to offboard and board passengers).

An example next step S208 of achieving lower cost control will now be described in more detail.

To operate large numbers of smaller vehicles, such as those made feasible by aspects of the invention, a major cost that is preferably addressed is the cost of operations. The present inventors recognize that, with small individually operated vehicles, the principal advantage gained by rail, the ability to carry large numbers of people in long trains with a small number of operators, is lost. If human operators are needed for each vehicle, the cost of labor will be not unlike the cost of taxi drivers or bus drivers for the car/bus service equivalent. Thus an important element for improving the amount of benefits per cost is the use of automation. In other words, vehicles are preferably made to operate without the need for a human operator on each.

The present inventors further recognize that automation, however, is not inexpensive. The capital cost of the high performance, high reliability, and vital controllers can be prohibitive. The cost of the control equipment that is used to operate conventional rapid transit system (e.g. BART) trains is upwards of $400,000 per train (a $200,000 controller is needed on each end of a train). A preferred aspect of the invention, therefore, is the use of a controller that is capable of achieving the required performance, reliability, and safety and is not cost prohibitive.

More particularly, the present inventors recognize that controllers that are used to operate driverless vehicles are required to meet a very high standard of safety. To meet this high standard, current practices require a very costly development program to design new systems.

The community of developers involved in the development and sales of vehicle controllers is referred to as the "Signalling" community or industry, and is made up of a relatively small community of very specialized companies. Within the signalling community, the term used to express the level of safety required of controllers of passenger-carrying vehicles is "vitality." This refers to a design and implementation attribute that equates, in essence, to never harming human life. In the past, vitality was not a quantitatively measureable attribute. Vital systems were said to have been made "failsafe" or in other words to only have failure modes that would result in a behavior that was deemed to be safe. For example, for the control of moving vehicles, stopping was always deemed to be a safe response so systems were designed to always cause a stoppage of vehicles when equipment failures occurred. This approach served well as long as the control functions and the equipment needed to perform the control functions were relatively simple. With simple electronic/electrical circuits performing the controls, component by component physical analyses of control circuits could be performed to prove that the failsafe attribute had been achieved. However, as computers and microprocessors arrived on the scene, control functions trended to become more and more complex, and the design then became more and more manifested in the design of the software programs that executed in the computers. This presented two problems. First with computers being electronic units made with millions of components, unlike the simple circuits of the past that were made up of a handful of components, it no longer became practical or even possible to prove a system to be failsafe. Second, with the use of computers, and the design being captured more in the software than in the circuits, demonstrating that the safety critical functions had been properly implemented in the software became an imperative. This is a very laborious and thus expensive process.

One consequence of the use of computer technology for vehicular control systems has been an evolution of the term "vital." Whereas in the past, to be vital meant an absence of unsafe failure modes or mechanisms, with computers it became necessary to define vitality in stochastic terms. In other words, as a probability. Today, a controller, in order to qualify as being vital, must be analyzed and demonstrated to have an extremely low probability of failing to an unsafe state. The generally accepted number today for achieving "vitality" is a probability of unsafe failure in one hour of operation equal to $10^{-9}$. This is often expressed in its reciprocal form as a Mean Time Between Unsafe Failure (MTBUF) or a Mean Time Between Hazard (MTBH) of $10^{9}$ hours. Achieving this level of safety, typically, but not always, requires the use of multiple levels of redundancy assembled together very carefully and in a well informed manner. This makes vital controllers very expensive. Furthermore as redundancy is depended upon for safety, component counts go up thereby driving down reliability.

The present inventors further recognize that another consequence of computer based, and thus software driven systems has been the need to analyze and demonstrate the absence of errors in the software design and implementation. This activity, referred to in the industry as Safety Validation and Verification (V&V) is, for anything but the most simple programs, so time consuming and laborious that it has become the major cost driver of system development.

Also, when smaller vehicles are used, fewer passengers are served by each vehicle. If each required a sophisticated controller on board, the cost of this hardware can become cost prohibitive. Thus, systems operating smaller vehicles such as the present invention preferably include ways to simplify and reduce the cost of the electronic controllers on board every vehicle.

Systems according to the present invention, therefore, preferably address one or both of the issues described above, 1) the high cost of controller software development and 2) the high cost of the controller hardware that must be carried on board the vehicles in the system.

An example approach is described more fully in co-pending application No. Ser. No. 13/218,423, the contents of which are incorporated by reference herein. In general, however, the conventional approach to the design of vehicle control systems distributes the need for vitality between computers wayside (not on the vehicle) and computers on the vehicles. As described in more detail in the co-pending application, the controller that is wayside receives requests from the supervisory computer and develops and sends commands to the vehicle. Since, commands, if wrong can lead to hazards, the wayside controller must be designed to be vital. Also, these commands are typically either speed commands or limits of authority, which being "complex" in nature, must be carefully encrypted and transmitted to and decoded by the vehicle borne controller. The vehicle controller, then develops control and actuation signals that actually control the propulsion, brake, and door systems which are the components on the vehicle that require vital control. Feedback from the driven components are then monitored by the vehicle controller to determine compliance with the commands from wayside and if non-compliance to a degree that jeopardizes safety is detected, emergency braking/door closure is initiated by the vehicle-borne controller. Since detection of the unsafe behavior of the vehicle is a responsibility of the vehicle-borne controller, the software in this equipment is vital and must be subjected to the expensive validation and verification process required of vital software. Finally, because of the safety critical nature of the functions implemented in both the wayside and vehicle-borne controllers, these processes must be implemented on expensive "vital" computing platforms.

In contrast, the approach of the present invention focuses all of the vitality in a monitoring function that resides wayside and all of the control functions in a non-vital computer that is also wayside. The monitoring function has the sole responsibility of monitoring for conditions that are potentially hazardous and generating a safety enable code (go/no go indication) that is sent along with control commands generated by the wayside controller. On board the vehicle the equipment is designed to require the presence of the safety enable code in order to withhold the actuation of emergency braking. Absence of the safety enable code disables the vehicle's ability to withhold braking, thus always resulting in a safe braking of the vehicle. To note here is that the only software code that needs to be validated and verified to be correct is the monitoring function which is considerably simpler than the control functions. This is because as a monitoring system, the only concern is the current state of the system and the only outcome it must produce is a "safe" or "not safe" decision. Control functions, on the other hand must develop complex results based on current and in some cases historical data (how much to accelerate, how fast to go, how far to go, when to brake, etc.) and can be much more difficult to validate and verify safety.

For example, with the approach according to the invention, the "vital" controller on the vehicle that is used in the conventional approach is replaced with a non-vital interface controller. Since a system that operates a large number of small vehicles will require a higher number of controllers, using smaller cars will negatively affect the amount of benefits per cost. Therefore, making the control hardware on the car less expensive is preferred. Replacing the expensive vital controller with a non-vital component makes the per unit cost cheaper and contributes significantly to improving the amount of benefits per cost of the system.

An example step S210 of developing the capability to safely achieve traffic density that is greater than that achievable with current train control systems, will now be described in more detail.

The present inventors recognize that train control systems that are currently available are not capable of achieving a preferred amount of traffic densities (i.e. superior amount of benefits per cost at a lower net cost). The primary reason for this limitation derives from the use of logic that assumes failsafe braking as the final line of defense against all potential hazards. With this limitation, superior traffic densities cannot be achieved.

To overcome this limitation, advances in control system design must occur, to allow higher traffic densities to be achieved. The methods required to achieve this performance generally include novel vehicle control methodologies and collision prevention methodologies described in more detail in co-pending application Ser. No. 13/218,429 and U.S. Pat. No. 8,554,397, the contents of which are incorporated herein by reference.

An example next step S212 of sizing cars to achieve an improved amount of benefits per cost with a lower net current cost will now be described in more detail.

The above described steps reduce the cost of transit by allowing the size and weight of vehicles to be reduced. However, the present inventors recognize that if not properly sized, reducing the size of the vehicle can negatively impact the amount of benefits per cost of fixed rail. Thus, another consideration of the invention is the sizing of the vehicles. According to some embodiments, the invention includes the use of cars that are sized to carry a nominal 20 passengers per car which are built to operate at times as two car consists. Although the exact size is not a required parameter of this invention, vehicles in this range are able to make possible certain aspects of this invention. In other words, equal advantages of the invention could not be achieved with a system operating personal rapid transit cars operating cars in the range of 2 to 4 passengers per car. Cars in the range of 10 to 30 passengers, however, would be considered within the range preferred by the invention.

To understand the importance of this parameter, the following discussion is provided.

Figure 6:
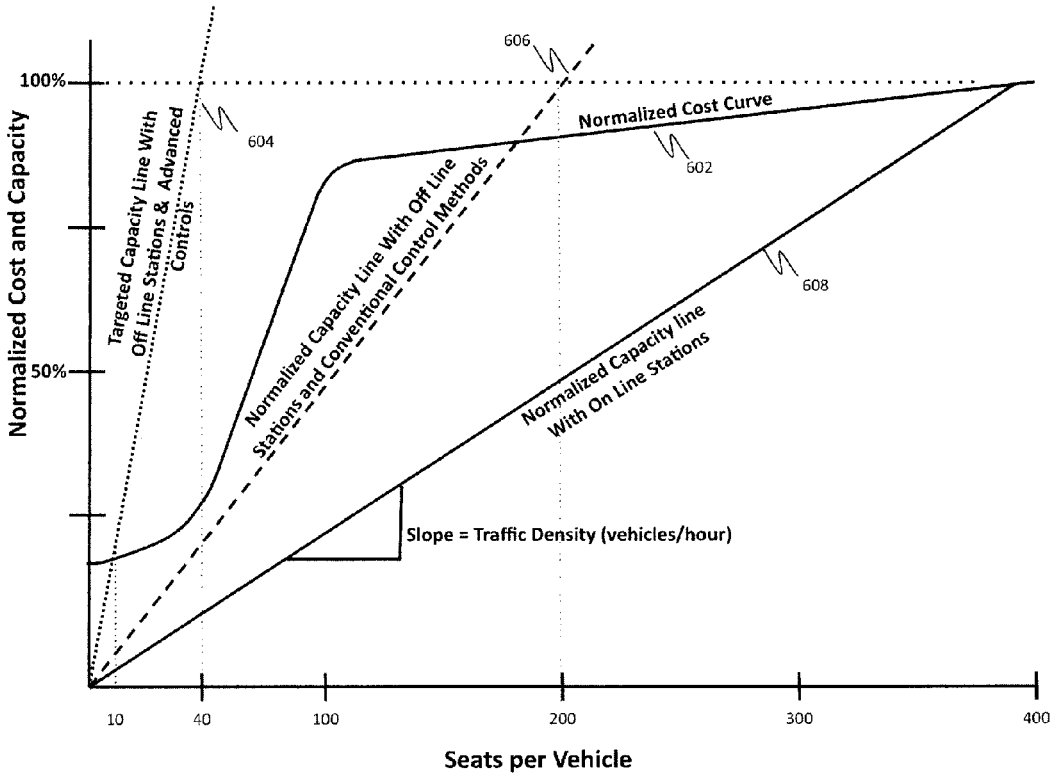
FIG. 6 illustrates principles of determining a vehicle size having improved benefits per cost according to aspects of the invention.

In FIG. 6, the relationship between system cost, system capacity and the size of the vehicle represented by the number of seats in a vehicle is illustrated. (Note: The graph shown in FIG. 6 is not strictly a product of plotted numerical data. The shapes and characteristics of each line depicted were drawn to illustrate the concepts of the invention discussed herein.) The term "vehicle" in this context refers to any single unit of transport. In the case of a system operating multiple-car consists, a vehicle would be the entire consist. For certain embodiments, with 20 passenger cars operating in two car consists, the vehicle size would be 40.) The lines on this figure are intended to illustrate the conceptual relationship between cost, capacity, and vehicle size. Also, the lines on this chart are each normalized to the maximum sized vehicle on the plot. As illustrated in FIG. 6, the general shape of line 602 (representing overall normalized cost) increases rapidly as the vehicle size increases until a vehicle size in the range of about 80 seats per vehicle is reached. Beyond this the curve becomes much more flat. This flattening results because when the number of seats exceeds about 80 seats per vehicle, the vehicle begins to span multiple elevated track segments each supported by a pair or columns. This is based on an observation by the present inventors that in modern transit cars, with four across seating, the length of a vehicle can be approximated to be roughly 1 foot for every seated passenger. Thus an 80-passenger vehicle would be approximately 80 feet long, which is approaching the practical limit of the spacing of the vertical columns of an elevated structure. With this distribution of weight, the strength of the structure does not need to continue to increase at the same rate as it did prior to reaching this vehicle size. The cost will, however, continue to rise but at a lower rate due to other effects such as the need to counter longitudinal forces during acceleration and deceleration and the need to build longer station platforms and thus larger station structures as the vehicles become longer and longer.

The lines 604, 606 and 608 show the conceptual relationship between line capacity and vehicle size. These lines are nearly straight at rapid transit speeds (60 to 80 mph) and so are shown as straight lines in this chart. In reality, the lines are slightly concave downward. The slope of each line 604, 606 and 608 is equal to the traffic density (vehicles/unit time), again normalized to show a capacity to cost ratio of 1.0 with a 400 seat vehicle. As annotated, the line 608 represents the capacity that can be achieved if the system is constructed with on line stations. The line 606 represents capacities that can be achieved if the stations are placed off line (i.e. with off ramps and on ramps for access) but with the same conventional control approach assumed for line 608. Note that line 606 is steeper than the line 608. This is because vehicles are no longer obstructed by other vehicles stopped in the platforms so a higher traffic density can be achieved. The amount of benefits per cost in each case is the ratio of the cost to capacity both of which are functions of vehicle size. As can be seen from this figure, with everything normalized to a capacity to cost ratio 1.0 for a 400 seat vehicle, the capacity to cost ratio with on line stations drops as the vehicle is made smaller and smaller. In other words, the benefits per cost becomes worse because the benefit (i.e. the capacity) drops faster than the cost. This situation is ameliorated to some extent by putting the stations off line (represented by line 606). However, even so, to achieve a line capacity equivalent to the capacity achieved with 400 seat vehicles for example, a 200 seat vehicle would be required and with this vehicle size, the capital cost of the system is still quite high, almost the same as for the system operating 400 seat vehicles. Cost at this point is still quite high, making it still difficult to justify the cost for low density corridors.

The line 604 represents the performance that can be achieved with the innovation introduced with the present invention's advanced control concepts. Here, line 604 crosses line 602 at about the 10 passengers per vehicle size and as the vehicle size is increased the amount of benefits (i.e. capacity) per cost improves dramatically. At the 40 passengers per vehicle size, a capacity equivalent to the capacity achieved with the largest vehicle size is achieved, but with a system that costs about one quarter the costs of the system operating 400 seat vehicles. This is almost a four-fold improvement in the amount of benefits per cost.

Summarizing the conclusions illustrated above, according to certain embodiments of the invention, with vehicle sizes under 10 passengers per vehicle, equivalent amount of benefits per cost to conventional transit cannot be achieved. At 10 passengers per vehicle an equivalent amount of benefits per cost is achieved and the system cost will be low but capacity will be far below that which is achievable with the larger vehicle sizes. As the vehicle size is increased, the amount of benefits per cost improves and at about the 40 passenger per vehicle size, the capacity achieved with the largest vehicle size is achieved, but at a significantly lower cost. The amount of benefits per cost continues to improve with vehicle size since, in this example, the capacity increases faster than the cost, but since this extra capacity will generally be more than is needed for short local applications, larger vehicle sizes results in a cost that may be impractical for low density local applications.

The discussion above illustrated how a proper sizing of the cars can improve the amount of benefits per cost of fixed rail. The discussion below further emphasizes the importance of properly sizing the car by examining how car size can impact the cost of the operation and maintenance of a rail system and thus affect the bottom line net present cost of ownership.

The present inventors recognize that the net present cost of ownership is the sum of the cost to procure and the net present cost to own and operate the system. This latter is as much affected by car size as is the capital cost of a system. However, the present inventors have discovered that, unlike the case for the capital cost, smaller does not necessarily translate to better.

The discussion to follow is based on a computational analysis performed on a specific hypothetical application of the invention, however the invention is not limited to this example. The application is a 5-mile system on which a fleet of 20-passenger vehicles operate serving 11 off line stations. To study the application, the present inventors created a cost model that included the cost of both the unscheduled and scheduled maintenance of cars as functions of vehicle miles operated. The model was validated against known costs of maintenance of existing systems such that a reasonable level of confidence that predictions generated by the model would produce "in the ball park" results.

Use of the model includes an estimation of total vehicle miles operated per year. This, of course, is very sensitive to vehicle size and increases as the vehicle is made smaller because to provide an equivalent number of passenger miles of service, more vehicle miles are needed as the vehicles are made smaller. Smaller vehicles, however, operate with greater efficiency because smaller vehicles are better able to match demand and thus fewer wasted seats are operated for the same level of service. This effect was studied in a study performed by BART and was documented in an investigative report. Taking vehicle size and operating efficiencies into consideration, the chart shown in FIG. 7 was produced and illustrates the relationship between vehicle size and the net present cost of ownership.

Figure 7:
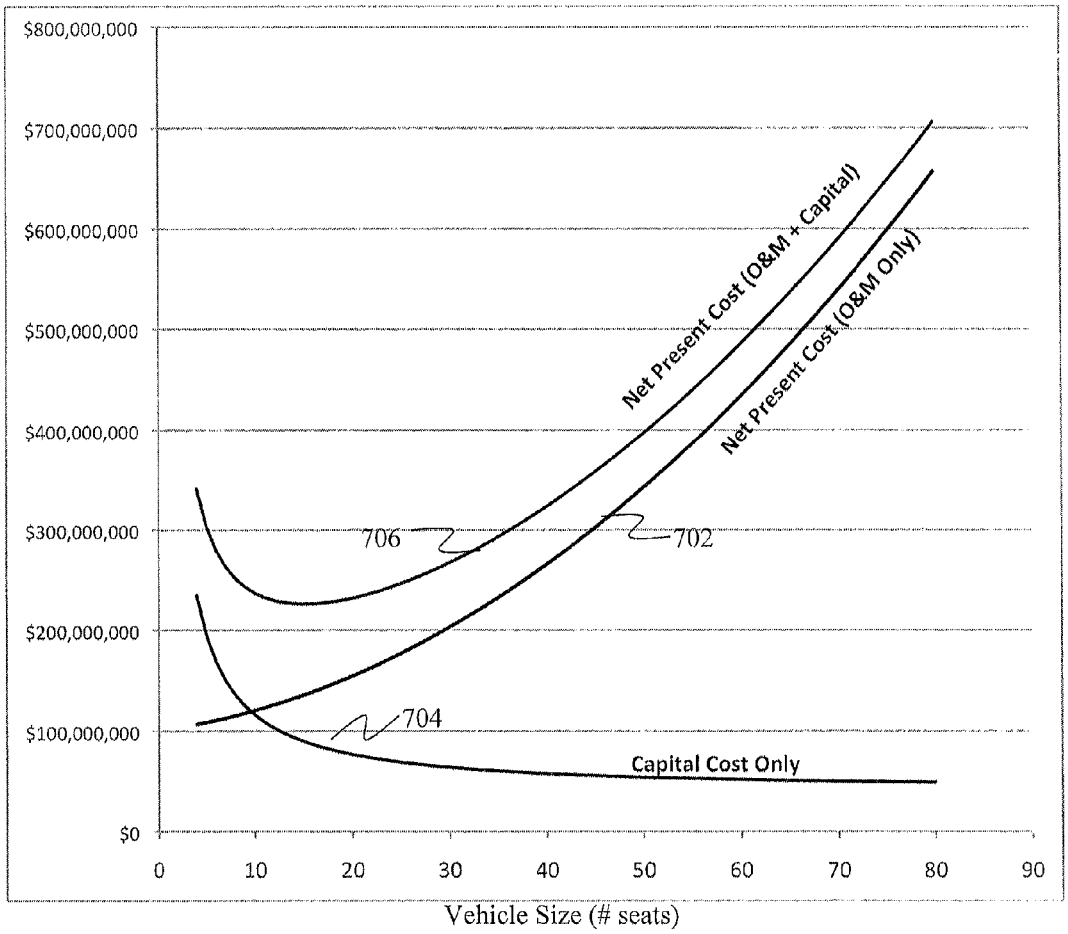
FIG. 7 further illustrates principles of determining a vehicle size having improved benefits per cost according to aspects of the invention.

In FIG. 7, line 702 is a plot of the predicted capital cost of procurement as a function of vehicle size. As expected the cost plot starts at a bit over $100,000,000 for the 5 mile system using small 4-passenger vehicles and then grows non-linearly as the vehicle size is made larger. Line 704 is a plot of the net present cost of 25 years of future maintenance. In this plot it was assumed that the cost would increase yearly at a rate of 4% while money in the bank would accrue interest at a rate of 3%. What is observed here is that the cost of maintaining a fleet of small vehicles is more expensive than the cost of operating a fleet of larger vehicles.

Line 706 is a plot of the combined capital and maintenance costs. As shown, it is a "bathtub" type curve with the minimum cost being achieved with a 15 seat vehicle. Accordingly, a 15 seat vehicle in this example application would result in an optimal net present cost of ownership.

The above discussion illustrates the importance of understanding the effects of vehicle size on a system's ratio of benefits per net present cost of ownership. As a result of this understanding, embodiments of the invention include systems built to operate vehicles in the range of 10 to 30 seats per vehicle.

Figure 8:
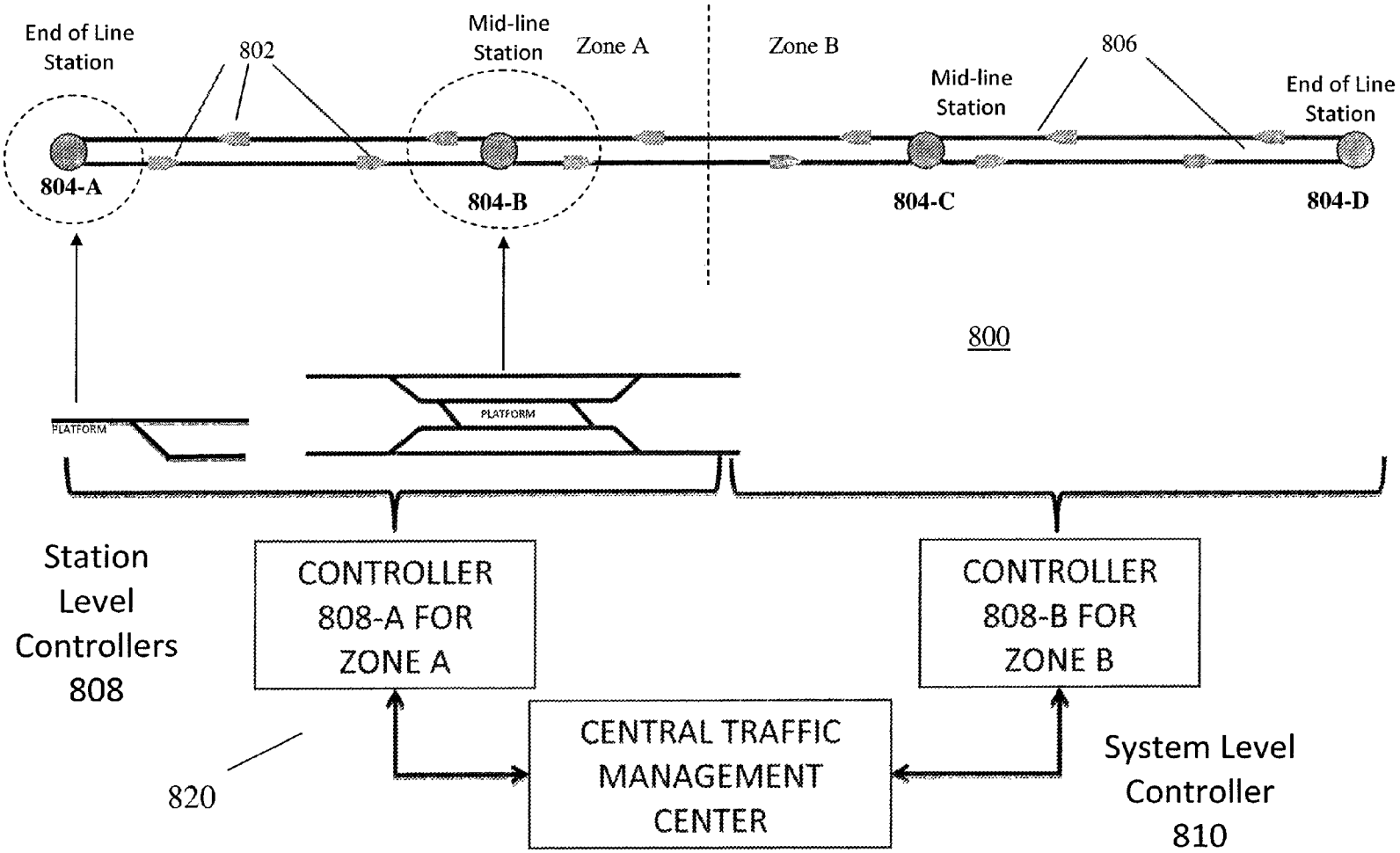
FIG. 8 illustrates an example transportation system that implements aspects of the present invention.

FIG. 8 is a diagram illustrating an example fixed guideway transportation system 800 implementing the optimized benefits per cost aspects of the present invention. As shown, the system 800 includes stations 804 and track 806. Vehicles 802 run on track 806 and collisions between them are prevented (e.g. safe separation distances between them are maintained) by control system 820.

Embodiments of the invention implement a fixed guideway transportation system 800 that result from the method for designing a system according to the invention described above. For example, system 800 uses grade-separated track at mode crossings, includes station platforms where stopped vehicles will not obstruct traffic flow, provides a cost effective way of controlling operation of the system (e.g. driverless cars with lower cost controllers), safely achieves traffic densities for the system that are greater than that achievable with current train control systems, configures the size of cars for the system that achieve an improved amount of benefits per cost with a lower net current cost. Moreover, although the principles of the inventions of the co-pending application and the present application are explained in connection with implementations using conventional diesel and/or electrified steel wheel on steel rail systems, the invention is not limited to these types of systems. For example, the principles of the invention can be extended to any other transportation systems that operate vehicles on trackways that are separated from pedestrians and all other types of vehicles, such as vehicles that operate with rubber tires on pavement (or otherwise without rails), vehicles that operate with non-steel wheels on rails, vehicles that utilize magnetic levitation and/or propulsion and vehicles that utilize pneumatic levitation and/or propulsion.

Although shown as a straight linear line in FIG. 8, this example is not limiting, and track 806 may comprise a more complex route including various merge points and diverge points. It should also be noted that, where service lines from two or more service corridors come together, interchanges similar to those with conventional freeway interchanges are possible.

In accordance with the high-density control principles of the present invention, all fixed obstacles have been eliminated from vehicles 802 running on track 806, Accordingly, stations 804 are off-line, for example using mid-line and/or end-of-line platforms such as those described above. Moreover, control system 820 implements communication based train control such as that described in co-pending application Ser. No. 13/316,402. Further, vehicles 802 include vehicle-based switching mechanisms such as those described in co-pending application Ser. No. 13/323,759. Moreover, vehicles 802 preferably include targeted brake rate functionality such as that described in co-pending application Ser. No. 13/316,398.

Generally, control system 820 comprises one or more computers that implement embodiments of the collision prevention methodology and vehicle control functions described in the co-pending applications. In the example shown in FIG. 8, the system is divided into two zones, Zone A and Zone B with a separate controller 808 having jurisdiction over each zone. Note that the number of zones comprising a system is not limited to two but can be any number as required for the service area. Second note that a Central Traffic Management Center 810 is needed which interfaces with each of the Zone Controllers 808 and monitors and manages traffic by accepting reports from each Zone Controller and issuing vehicle movement requests to each Zone Controller. A large system need not be limited to a single Traffic Management Center and can in fact include multiple centers all connected together and sharing traffic information from the other centers.

In embodiments, system 800 preferably employs an overall collision prevention scheme described in more detail in co-pending application Ser. No. 13/218,429, and may further include vehicle control functionality such as that described in co-pending application Ser. No. 13/323,768. Furthermore, system 800 includes control systems that are implemented in accordance with the reduced-cost aspects described in more detail in co-pending application Ser. No. 13/218,423.

The net results of the methods described above for a local system 800 achieve with moderately sized (e.g. 20 passenger) vehicles: a ratio of benefits per cost for fixed guideway transit in low density/low speed corridors that significantly improves the case for using fixed guideway technology for local (i.e. approximately 10 miles end to end) transport needs; and a transport capacity that is equivalent to that achieved with modern mass rapid transit technology that typically spans longer distances.

Combining this with the expectation that moderately sized 20 passenger vehicles, 30 to 40 feet in length can 1) travel deep enough into urban/suburban communities to stations within walking distance of most destinations/origins (arterial corridors) and 2) be designed to achieve speeds in the range of 100 to 150 mph, the present inventors recognize that the methods of the invention can be extended to a system of interconnected uni-modal trackways that can cost-effectively serve local, regional, and inter-regional transport needs.

Figure 9:
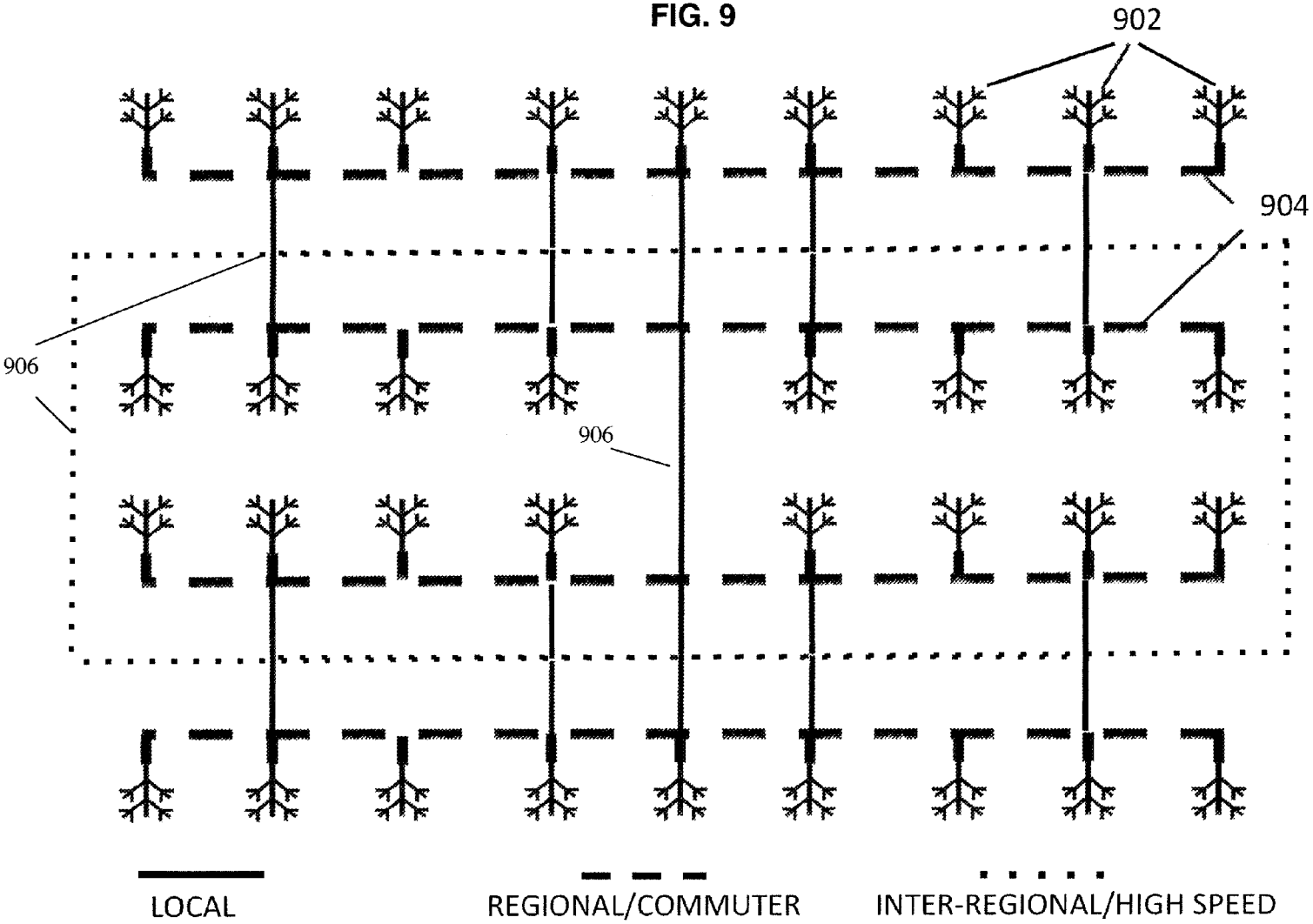
FIG. 9 illustrates an example transportation internet with local and regional portions implementing certain aspects of the present invention.

For example, as shown in FIG. 9, local systems 902 can be implemented similarly to system 800 described above in connection with FIG. 8. These local systems 902 can be interconnected with regional lines 904 using a hierarchy of control systems as described above, as will be appreciated by those skilled in the art. These regional systems 904 can further be interconnected with inter-regional lines 906, forming inter-regional systems that have an additional hierarchy of control systems. In other words, multiple Central Traffic Management Centers 810 may be needed, with each having jurisdiction over about a 100 mile radius service area and a management layer may be needed to integrate/coordinate the traffic management responsibilities of each of the Central Traffic Management Centers.

The overall system shown in FIG. 9 achieves what is referred to here as a Ground Transportation Internet. In accordance with aspects of the invention, it implements the following methods described above:

1. Construct all track to be separated from road and pedestrian traffic.
2. Place all stations off line.
3. Utilize fully automated driverless vehicles.
4. Eliminate track enforced switching by implementing a switching mechanism on board the vehicle.
5. Design and implement a collision avoidance system that safely allows the higher traffic densities as described in the co-pending applications.
6. Use a control methodology that eliminates the need for high cost control hardware on each vehicle as described in the co-pending applications.
7. Manage traffic using algorithms that avoid conflicts at system merge points as described in the co-pending applications.
8. Use vehicles that are moderately sized (20 to 30 seat vehicles).

In accordance with additional aspects, the system shown in FIG. 9 further preferably implements the following methodologies:

1. Use a common track gauge system-wide.
2. Establish and use a common control standard system-wide.
3. For regional/commuter service, design and utilize vehicles capable of operating at speeds in the range of 60 to 80 mph.
4. For inter-regional transport, design and utilize vehicles capable of reaching speeds in the range of 100 to 150 mph.

With the above methods utilized in totality, travel from any point in the network to any other point in the network will be achievable on a common vehicle without transfers to form a truly uni-modal fixed guideway transportation internet.

Although the system in FIG. 9 shows all local routes being connected to the entire network, this is not necessary. For example, some local routes may not be connected by inter-city lines at all, and some local routes may connected to other local routes, but not to other regions. Moreover some regions may be connected together with other regions but not with certain further regions. Those skilled in the art will understand the variety of combinations that are possible after being taught by these examples.

Although the present invention has been particularly described with reference to the preferred embodiments thereof, it should be readily apparent to those of ordinary skill in the art that changes and modifications in the form and details may be made without departing from the spirit and scope of the invention. It is intended that the appended claims encompass such changes and modifications.

What is claimed is:

1. A driverless transportation system consisting essentially of:

a fixed guideway forming a route for transporting a plurality of driverless vehicles thereon;

separated grade at all mode crossings along the route;

off-line stations at all stops within the route; and a control system for controlling movement of the vehicles throughout the route, wherein the control system comprises controllers in each of the vehicles communicating with one or more higher-level controllers, wherein vital control functions that have been verified to have a predetermined low failure rate are concentrated in the higher-level controllers to the exclusion of any such vital control functions in the vehicles, and wherein the control system provides an optimal traffic density by eliminating fixed obstacles along the route, and wherein the vehicles are sized to transport an optimal number of passengers for the optimal traffic density.

2. A driverless transportation system according to claim 1, wherein the optimal number of passengers is between around 10 and 30.

3. A driverless transportation system according to claim 1, wherein the control system permits a first vehicle temporarily stopped at one of the off-line stations to be passed by a second vehicle proceeding along the route without stopping at the one off-line station.

4. A driverless transportation system according to claim 1, wherein the off-line stations comprise mid-line stations and end-of-line stations.

5. A driverless transportation system according to claim 4, wherein certain of the mid-line stations and end-of-line stations allow vehicles traveling in a first direction along the route and stopping at the certain stations to travel in a second direction opposite the first direction along the route after stopping at the certain stations.

6. A driverless transportation system according to claim 4, wherein the off-line stations are on the same grade as a mainline portion of the route and accessed using a ramp line.

7. A driverless transportation system according to claim 1, wherein the off-line stations include mid-line stations, and wherein certain of the mid-line stations allow vehicles traveling in a first direction along the route and stopping at the certain stations to travel in a second direction opposite the first direction along the route after stopping at the certain stations.

8. A driverless transportation system according to claim 1, wherein the mode crossings are configured to separate in grade between track used by the vehicles from and the grade of one or both of pedestrian and automobile traffic.

9. A driverless transportation system according to claim 1, wherein the off-line stations are on the same grade as a mainline portion of the route and accessed using a ramp line.

10. A driverless transportation system according to claim 1, wherein the off-line stations are separated in grade from a mainline portion of the route by a platform.

11. A driverless transportation system according to claim 1, wherein the controllers in the vehicles comprise a non-vital processor that detects the presence of a safety enable code.

12. A driverless transportation system according to claim 11, wherein if the non-vital processor does not detect the safety enable code after a predetermined amount of time, the associated vehicle is stopped.

13. A driverless transportation system comprising:

a first local system consisting essentially of:

a first fixed guideway forming a first local route for transporting a plurality of driverless vehicles thereon;

street-traffic separated at all mode crossings along the first local route;

first off-line stations at all stops within the first local route; and a first control system for controlling movement of the vehicles throughout the first local route, wherein the first control system comprises controllers in each of the vehicles communicating with one or more first higher-level controllers, wherein vital control functions that have been verified to have a predetermined low failure rate are concentrated in the first higher-level controllers to the exclusion of any such vital control functions in the vehicles, and wherein the first control system achieves an increased traffic density by eliminating fixed obstacles along the first local route, and wherein the vehicles are sized to achieve a line capacity such that a benefit to cost of ownership ratio is optimized;

a second local system consisting essentially of:

a second fixed guideway forming a second local route for transporting the plurality of driverless vehicles thereon;

street traffic separated at all mode crossings along the second local route;

second off-line stations at all stops within the second local route; and a second control system for controlling movement of the vehicles throughout the second local route, wherein the second control system comprises the controllers in each of the vehicles communicating with one or more second higher-level controllers, wherein vital control functions that have been verified to have a predetermined low failure rate are concentrated in the second higher-level controllers to the exclusion of any such vital control functions in the vehicles, and wherein the second control system achieves an increased traffic density by eliminating fixed obstacles along the second local route; and an inter-city line connecting the first and second local systems on which vehicles designed and certified to achieve higher speeds operate.

14. A driverless transportation system according to claim 13, wherein the vehicles are capable of achieving speeds of at least 60 to 80 mph to travel on the local systems and the inter-city line.

15. A driverless transportation system according to claim 13, wherein the first fixed guideway, the second fixed guideway and the inter-city line all have a common track gauge.

16. A driverless transportation system according to claim 13, wherein a number of passengers accommodated by the plurality of driverless vehicles in the first and second fixed guideways is between around 10 and 30.

17. A driverless transportation system according to claim 13, further comprising:

a third local system consisting essentially of:

a third fixed guideway forming a third local route for transporting the plurality of driverless vehicles thereon;

street traffic separated at all mode crossings along the third local route;

third off-line stations at all stops within the third local route; and a third control system for controlling movement of the vehicles throughout the third local route, wherein the third control system comprises the controllers in each of the vehicles communicating with one or more third higher-level controllers, wherein vital control functions are concentrated in the third higher-level controllers, and wherein the third control system achieves an increased traffic density by eliminating fixed obstacles along the third local route, wherein the inter-city line is constructed to connect the first and second local routes and to bypass the third local route.

18. A driverless transportation system according to claim 13, further comprising:

a third local system consisting essentially of:

a third fixed guideway forming a third local route for transporting the plurality of driverless vehicles thereon;

street traffic separated at all mode crossings along the third local route;

third off-line stations at all stops within the third local route; and a third control system for controlling movement of the vehicles throughout the third local route, wherein the third control system comprises the controllers in each of the vehicles communicating with one or more third higher-level controllers, wherein vital control functions are concentrated in the third higher-level controllers; and an inter-regional line that connects the third local route to the inter-city line, wherein a single common vehicle in the system can operate on all of the local routes, the inter-city line and the inter-regional line so that it is physically possible for passengers to travel between any point in the local routes without transferring to another vehicle.

* * * * *